US009376238B2

(12) United States Patent
Landow

(10) Patent No.: US 9,376,238 B2
(45) Date of Patent: Jun. 28, 2016

(54) PRESENTATION PACKAGE FOR MIXED BEVERAGE COMPONENTS

(71) Applicant: William A Landow, Denver, CO (US)

(72) Inventor: William A Landow, Denver, CO (US)

( * ) Notice: Subject to any disclaimer, the term of this patent is extended or adjusted under 35 U.S.C. 154(b) by 153 days.

(21) Appl. No.: 14/447,162

(22) Filed: Jul. 30, 2014

(65) Prior Publication Data

US 2015/0041343 A1 Feb. 12, 2015

Related U.S. Application Data

(60) Provisional application No. 61/862,895, filed on Aug. 6, 2013.

(51) Int. Cl.
*B65D 3/24* (2006.01)
*B65D 25/20* (2006.01)
*B65D 71/50* (2006.01)

(52) U.S. Cl.
CPC ..... *B65D 25/205* (2013.01); *B65D 71/50* (2013.01); *B65D 71/504* (2013.01)

(58) Field of Classification Search
USPC ..... 220/737, 738; 229/902, 904, 906; 206/216, 217
See application file for complete search history.

(56) References Cited

U.S. PATENT DOCUMENTS 1,436,583 A 11/1922 Feist
1,536,445 A 5/1925 Maupai
1,871,598 A 8/1932 Everson
2,340,719 A 2/1944 Walter
3,831,300 A 8/1974 Berkhouse
4,377,234 A * 3/1983 Kaplan ..... B65D 71/08 206/432
4,620,631 A * 11/1986 Bartelt ..... A47G 23/0225 206/217
D306,614 S 3/1990 Kodner
5,289,650 A 3/1994 Follett
5,390,435 A 2/1995 Grody
5,435,085 A 7/1995 Johnson
5,474,173 A 12/1995 Hodapp
5,782,357 A 7/1998 Johnson
5,826,356 A 10/1998 Lapp
5,960,973 A 10/1999 Markson
6,138,902 A * 10/2000 Welch ..... B65D 81/3886 206/815
6,286,798 B1 * 9/2001 Chun ..... A47G 23/0216 206/218
6,385,874 B1 5/2002 Tsonas
6,612,485 B2 * 9/2003 Lackner ..... B65D 3/28 220/23.83
6,644,540 B2 * 11/2003 Jamitzky ..... B65D 5/48014 229/117
6,799,390 B2 10/2004 Bradley
2005/0217153 A1 10/2005 Ward, II
2005/0229450 A1 10/2005 Larsen
2006/0131316 A1 * 6/2006 Bresler ..... B65D 81/3874 220/737
2008/0217388 A1 9/2008 Brayshaw
2013/0126540 A1 * 5/2013 Vesterby ..... B65D 37/00 220/737

* cited by examiner

*Primary Examiner* — Jacob K Ackun
(74) *Attorney, Agent, or Firm* — Leyendecker & Lemire LLC

(57) ABSTRACT

A presentation package for providing a "mixed drink", such as a gift, wherein the mixer or base beverage is contained in a first container, such as a 12 ounce soda can, and the liquor is provided in a second container, such as a small single serving liquor bottle, is described. The two containers are joined together by the presentation package. The package further includes indicia relative to the occasion associated with the giving or presentation of the "mixed drink" combination.

4 Claims, 7 Drawing Sheets

PRESENTATION PACKAGE FOR MIXED BEVERAGE COMPONENTS

CROSS REFERENCE TO RELATED APPLICATIONS

This application claims priority to U.S. provisional patent application No. 61,862,895 entitled Quaff Card filed on Aug. 6, 2013 and having the same inventor as the present application. The provisional application is incorporated herein by reference in its entirety.

FIELD OF THE INVENTION

The present invention pertains to packaging for unifying the components of a mixed beverage .

BACKGROUND

Commonly on commercial airline flights, travelers can purchase alcoholic beverages to be consumed during the flight. The beverages are most typically delivered to the purchaser in component form with the liquor or spirit being provided in a small single serving bottle containing about 50 ml of liquid. The traveler then adds some or all of the alcohol to a provided beverage receptacle along with a mixer, such as ginger ale or cola to create a mixed drink.

In bars, patrons often buy friends and acquaintances a drink as a friendly social gesture. Typically, a bartender mixes the drink and he/she or a waiter/waitress a delivers the drink to the receiving patron. However, no convenient means presently exists for a person to give another a mixed drink outside of a household bar setting as a gift to be consumed at a time convenient to the recipient.

DETAILED DESCRIPTION

Figure 1:
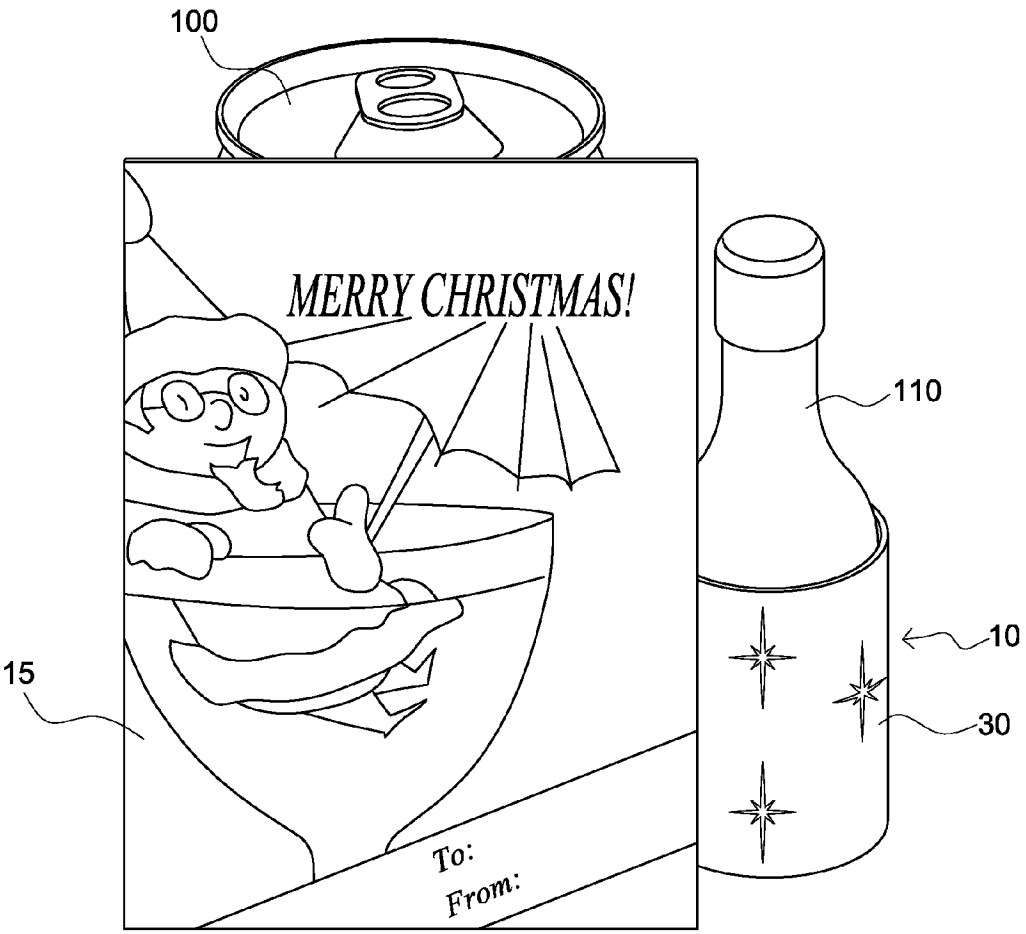
FIG. 1 is a perspective front view of the presentation package with a canned beverage and an individual serving bottle of spirits received therein according to one embodiment of the present invention.

Embodiments of the invention comprise a presentation package for providing a "mixed drink", such as a gift, wherein the mixer or base beverage is contained in a first container, such as a 12 ounce soda can, and the liquor is provided in a second container, such as a small single serving liquor bottle. The two containers are joined together by the presentation package.

The presentation package is typically comprised of an elongated strip of paper card stock (securing strip) including one or more adhesive strips provided thereon that facilitates each end of the strip to be rolled into and secured in a cylindrical format that can hold one of the first and second containers. In certain embodiments, the presentation package includes a card or tag (informational card) that can be or is adhesively secured to the securing strip, typically at a larger first loop portion. The card/tag typically includes printing and other indicia printed thereon that conveys a desired message, such as "Merry Christmas", and provides a space to identify the giver and intended recipient. Variations are contemplated wherein the informational card contains advertising indicia. For instance, an airline might package a cola can with a single serving liquor bottle of rum and provide a message about the airline on the informational card.

Some embodiments are provided in a folded flat partially assembled configuration wherein a first loop for a first beverage container such as a 12 ounce aluminum can is preformed and a strap portion extends from the loop to be wrapped around the second beverage container, such as the single serving bottle and secured in place with an adhesive strip against the first or preformed loop to create a second loop. The informational card is typically adhesively secured to the first loop. To facilitate the folded flat configuration, which permits efficient packaging of the presentation package the securing strip has several folds.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

Embodiments of a Presentation Package for Two Beverage Containers

Figure 4:
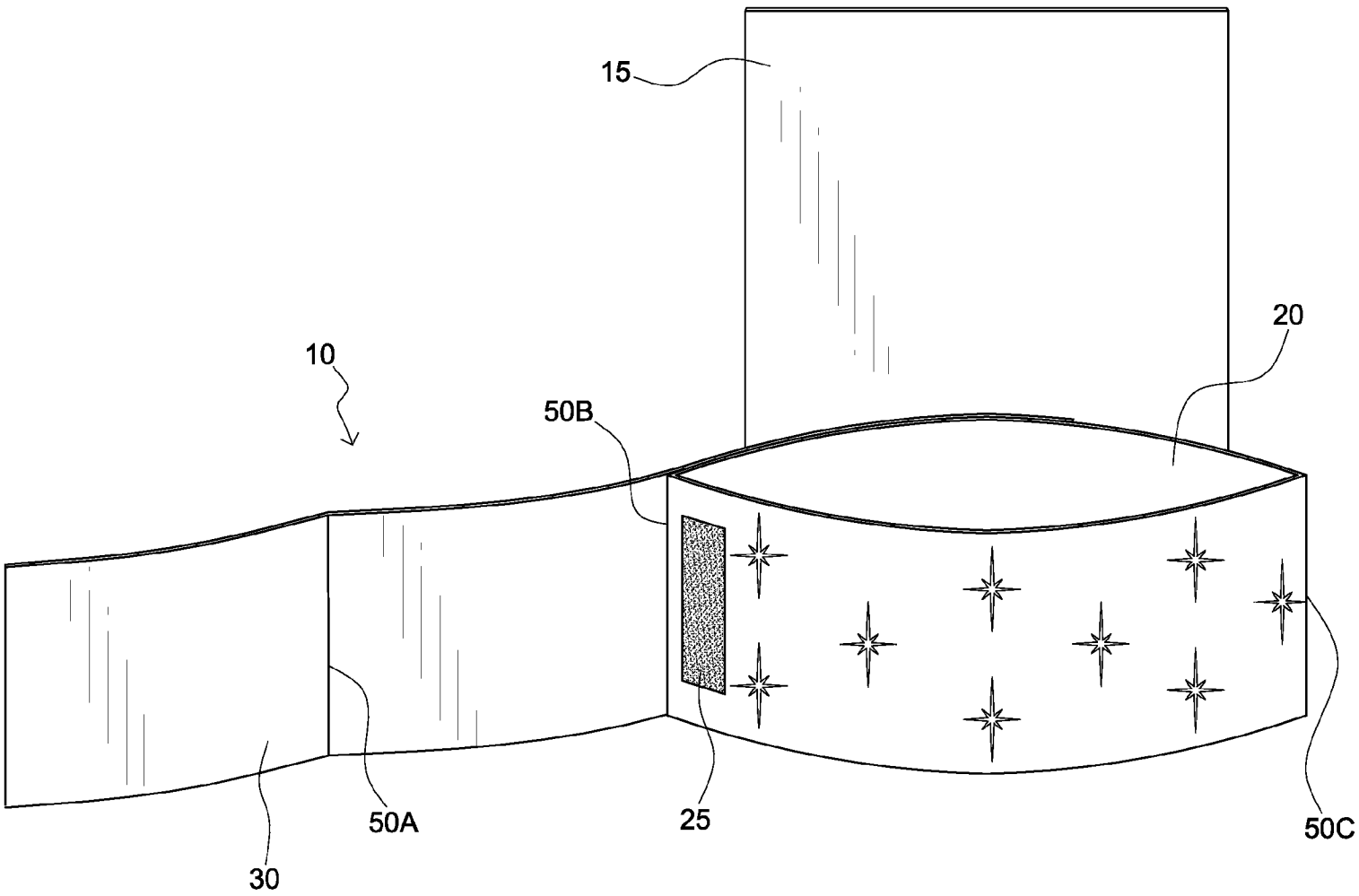
FIG. 4 is a perspective rear view of the presentation package unfolded but prior to insertion of a canned beverage and an individual serving bottle of spirits therein according to one embodiment of the present invention.
Figure 5:
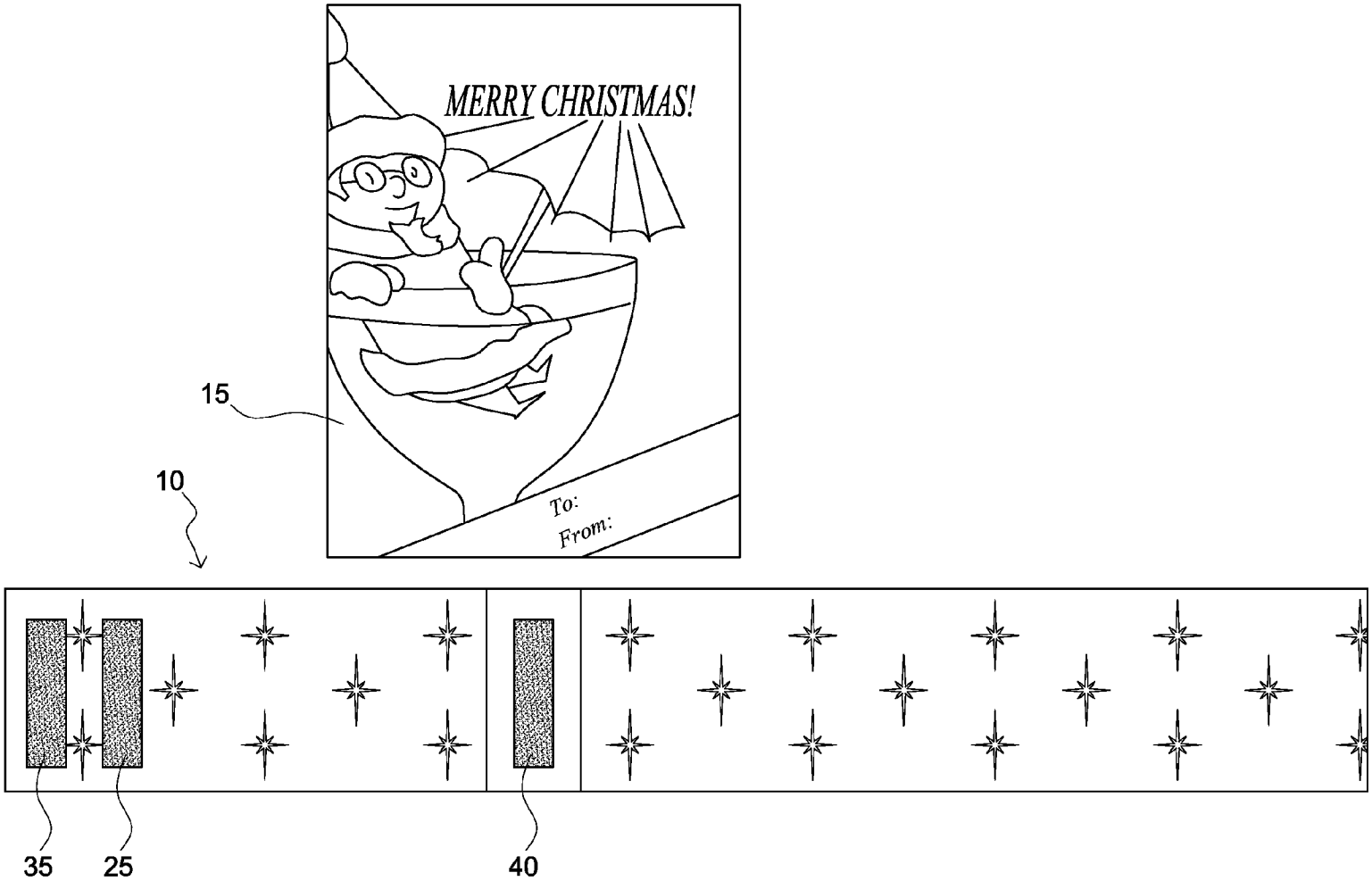
FIG. 5 is a front view of the presentation package in a disassembled configuration comprising the securing strip and the associated card according to one embodiment of the present invention.

FIGS. 1-6 illustrate various views and configurations of an embodiment of the presentation package. The package is typically comprised of two major components: a securing strip 10 and an informational card 15 as can be seen in the various figures. Several adhesive strips 25, 35 & 40 are also provided as are best seen in FIG. 5. The adhesive strips facilitate the formation of first and second loops to hold the respective first and second beverage containers as well as facilitate connection of the informational card to the securing strip 10.

The front side of a securing strip 10 showing the exterior surface thereof is best illustrated in FIG. 5 prior to formation into the presentation package. The strip typically comprises a paper card stock although other suitable materials can be used, such as plastic sheet. In one embodiment configured to hold a typical aluminum 12 ounce beverage container 100 and a single serving liquor bottle 110 as illustrated for instance in FIGS. 1 & 2, the strip is about 2.25" wide and about 17" long. The exterior surface is substantially covered in printed graphics commensurate with the intended use of the particular presentation package. For instance, a presentation package intended to be given around the Christmas holiday may be covered in holiday-themed indicia, such as Christmas trees, stars, and bells; whereas, a package provided by an airline in the delivery of a mixed drink to a traveler may include images of the particular airline's logo and colors. In the illustrations, typical holiday themed indicia are shown imprinted on the strip of FIG. 5, but is not shown in the remaining Figures. The backside surface of the securing strip is often not imprinted but it can be in variations.

Also, as shown in FIG. 5, a vertical stripe appears approximately 7.5" from one edge of the strip 10. The stripe actually comprises a section of the exterior surface in which no graphics have been imprinted. It serves as a marker as to the location at which the informational card 15 is adhesively secured to the strip. As also shown in FIG. 5, an adhesive strip 40 can be used in certain variations at this location to secure the card to the strip although other means to secure the card to the strip can also be used including any suitable type of liquid or paste adhesive or a mechanical fastener.

Still referring to FIG. 5, two additional adhesive strips 25 & 35 are provided on the strip 10. The leftmost adhesive strip 35 is used to secure the end against the backside of the securing strip approximately halfway along its length to create the first loop portion 20 as can be best seen in FIG. 4. In the illustrated embodiment, the loop is preformed and sized to receive a standard 12 ounce aluminum can when unfolded. In variations, the securing strip 10 can be provided as an unformed piece with a removable release film or layer proved over the adhesive strip wherein the user of the package can form his/her own loop(s) to fit the specific sizes of the beverage containers to be joined.

A third adhesive strip 25 is provided just to the right of the leftmost adhesive strip. This adhesive strip is used to secure the second loop that is made from rolling the strap portion 30 around a second beverage container, such as a single serving liquor bottle, most often by the user. Because the second loop is formed by the package's user, the adhesive strip is typically provided with a removable release film in place to protect the underlying adhesive prior to use.

Figure 6:
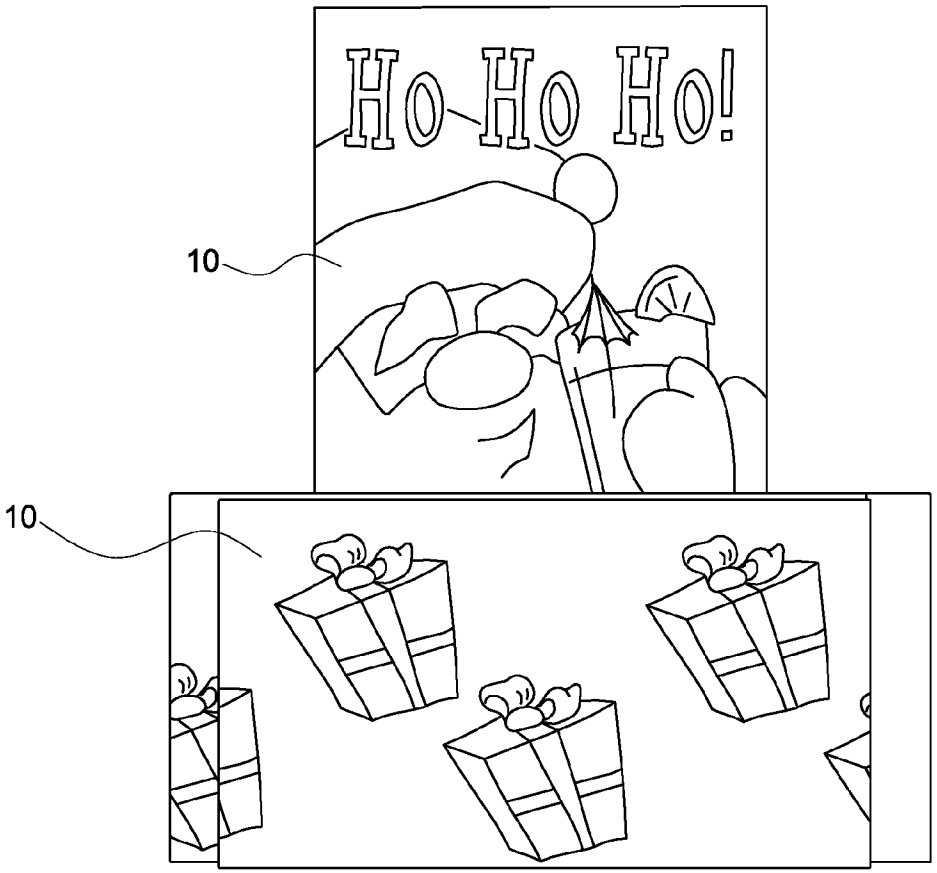
FIG. 6 is a front view of the presentation package in a folded configuration prior to unfolding and subsequent use according to one embodiment of the present invention.

As can be best seen in FIG. 4, three laterally-extending folds 50*a-c* are provided in the securing strip 10. These folds permit the presentation package to be compactly folded flat as shown in FIG. 6. In the illustrated embodiment, the 17" securing strip, which is about 11.5" long after the first loop portion has been formed, is reduced to about 4" in length when folded. The folded configuration facilitates easier and more compact packaging and consequently shipping of the presentation package prior to use.

The informational card 15 is separately illustrated in FIG. 5. It typically comprises a rectangular piece of card stock with graphics and other indicia printed at least on a front side commiserate with the occasion pertaining to the presentation package's intended use. When the package is to be used in relation to a gift, the indicia can include spaces from the giver to write his/her name as well as the name of the intended recipient. The configuration, the graphics, the content of the indicia, the material and the size of the informational card can all vary substantially in variations and embodiments as would be obvious to one of ordinary skill in the art given the benefit of this disclosure.

As illustrated and as described above, the card is typically attached to the securing strip at the first loop portion most often using an adhesive. In alternatives, however, the card portion can be integrally formed as part of the same piece forming the securing strip with the card portion extending above the top edge of the securing strip. In this variation, the card portion would be differentiated from the rest of the securing strip and the first loop portion by its shape and the graphics printed thereon.

A Method of using an Embodiment of the Presentation Packaging

Figure 7:
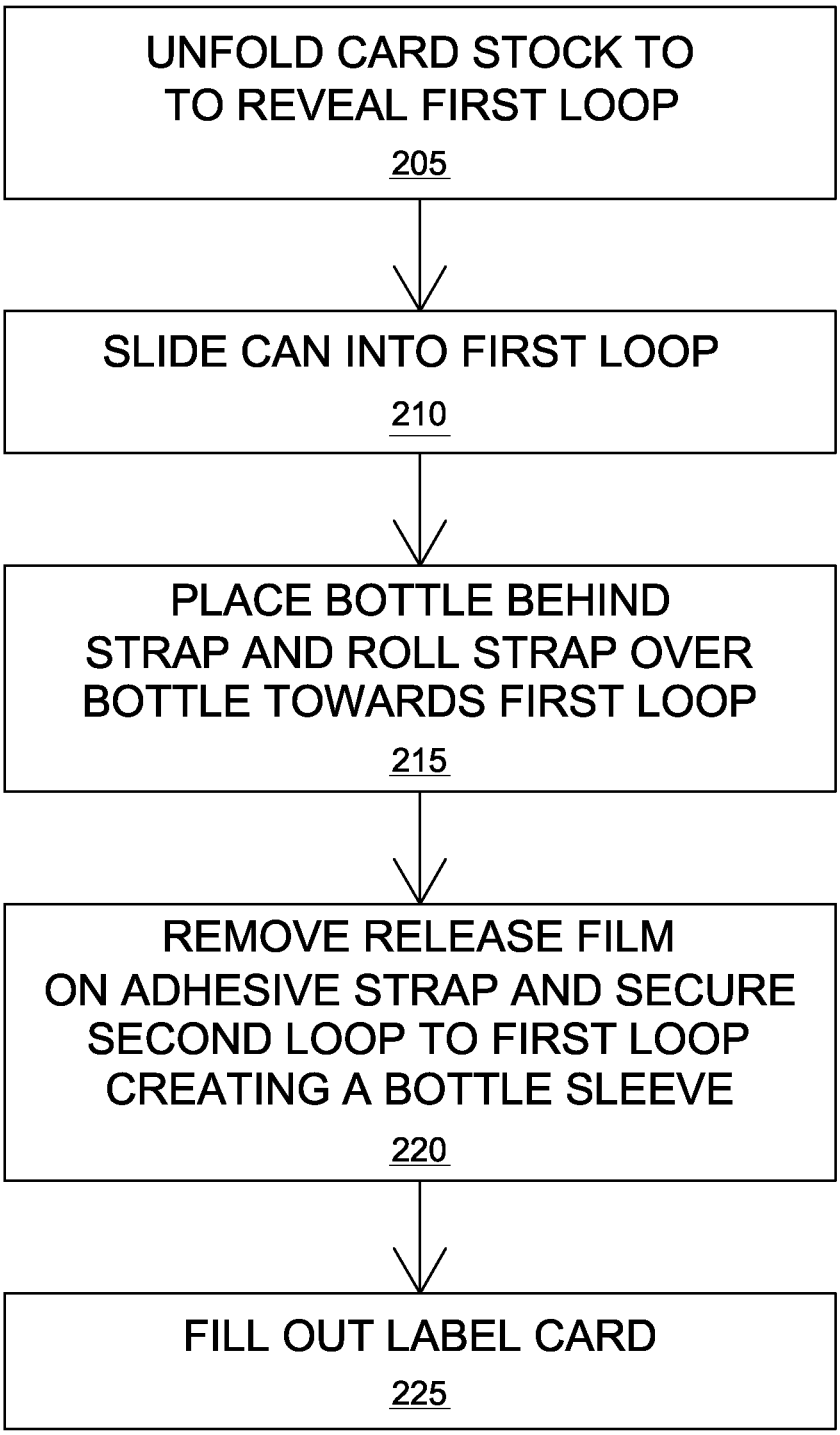
FIG. 7 is a flow chart describing the assembly of the presentation package to secure both a beverage can and a single serving bottle of spirits therein according to one embodiment of the present invention.

The presentation packaging is typically provided in the folded configuration of FIG. 6 its own packaging, such as a cellophane bag and associated hang label/tag. The presentation package can be sold individually or with several other units. A method of using the presentation packaging is described in the flow chart of FIG. 7.

Figure 2:
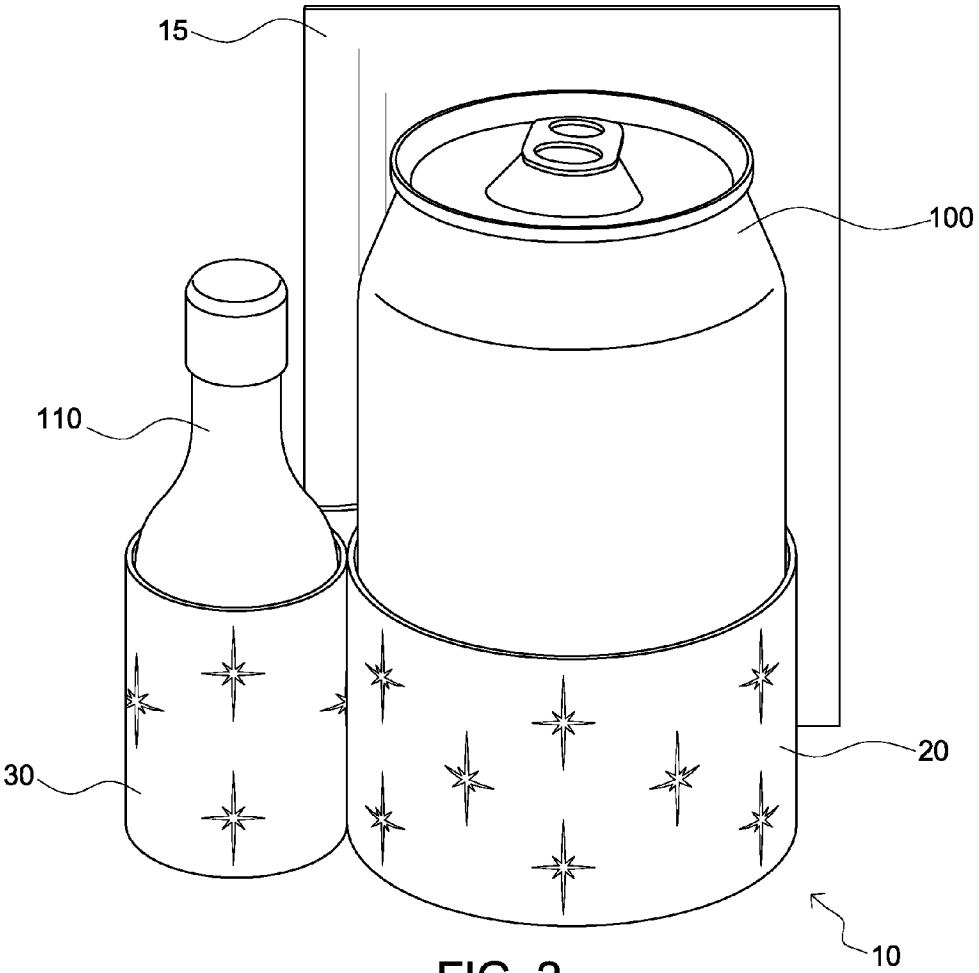
FIG. 2 is a perspective rear view of the presentation package with a canned beverage and an individual serving of spirits received therein according to one embodiment of the present invention.
Figure 3:
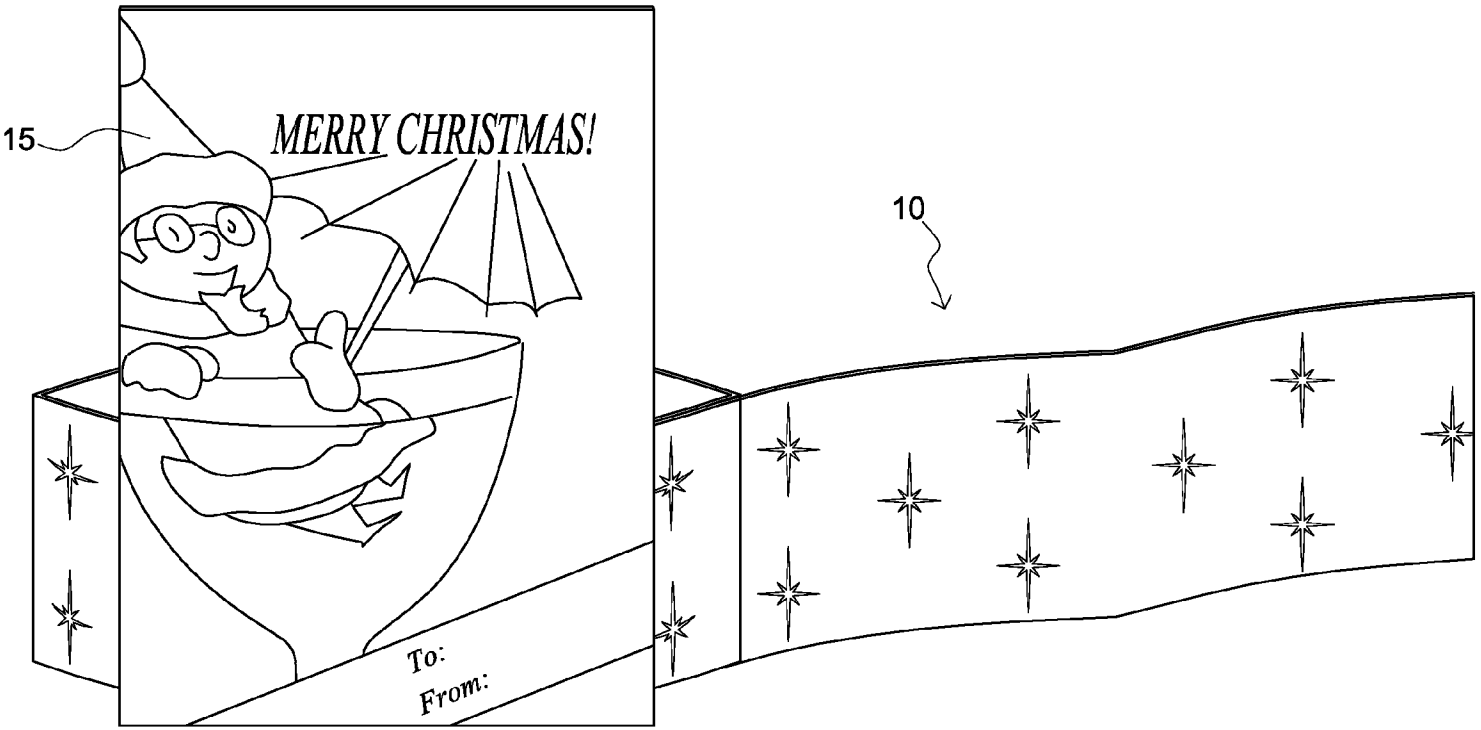
FIG. 3 is a perspective front view of the presentation package unfolded but prior to insertion of a canned beverage and an individual serving bottle of spirits therein according to one embodiment of the present invention.

First as indicated in block 205, the user unfolds the securing strip/card stock to reveal the first loop 20 (or can sleeve) and the strap portion 30 as shown in FIGS. 2 & 4. Next as indicated in block 210, the user slides a container, such as a 12 ounce aluminum can containing a beverage, into the first loop.

Referring to blocks 215, the user places a second beverage container, such as a single serving liquor bottle, and rolls the strap 30 around the second beverage container bringing the container next to the first container surrounded in a second loop. As indicated in block 220, the release film is removed from the adjacent adhesive strip 25 on the first loop and the outside of the second loop is pressed against the strip to secure it in place creating a coupled deconstructed mixed drink as best shown in FIGS. 1 & 2.

As necessary and as indicated in block 225, the user can fill out the informational card indicating the giver of the mixed drink and the intended recipient. In a variation of the described method, the user may fill out the informational card at other points of the process, such as before applying the packaging to the referenced beverage containers.

Variations and Other Embodiments

Numerous variations of the device are contemplated as would be obvious to one of ordinary skill in the art given the benefit of this disclosure. For instance, the elongated strip and or card can be made of plastic instead of card stock. Instead of adhesive strips complimentary slots could be provided to form the first and second portions into the first and second cylindrical portions. In yet other variations the card/tag can be an integral part of the elongated strip. It is to be appreciated that use of the device is not limited to the giving of mixed drinks but can be purposed to secure any two items together as a single gift unit.

In one alternative embodiment, the securing strip and associated informational card are replaced with a heat-shrinkable cylindrical plastic sleeve. The exterior surface of the sleeve includes indicia printed thereon including but not necessarily limited to graphics and written material. In use the sleeve is placed over the two beverage containers and when heat is applied to the sleeve it shrinks around the containers and affixes them in place against each other.

I claim:

1. A method of using a presentation package, the method comprising:

providing the presentation package, the presentation package comprising, (i) a securing strip, the securing strip including a first loop portion with an exterior surface and an elongated strap portion having an outside surface and an inside surface, (ii) a first adhesive strip secured to the exterior surface proximate an intersection of the first loop portion and the strap portion with the first adhesive strip includes a removable release layer, and (iii) an informational card secured to the securing strip, the informational card including indicia printed thereon;

sliding a first beverage container into the first loop portion;

placing a second beverage container against the inside surface of the strap portion;

rolling the strap portion around the bottle towards an intersection with the first loop portion;

removing the release layer from the first adhesive strip; and pressing the outside surface against the first adhesive strip to create a second loop portion from the strap portion.

2. The method of claim 1, further comprising unfolding the presentation package.

3. The method of claim 1, further comprising writing one or both the name of the giver and the recipient on the informational card.

4. A method of using in combination a presentation package, a first beverage container and a second beverage container, the method comprising:

providing the first beverage container, the first beverage container comprising an aluminum can;

providing the second beverage container, the second beverage container comprising an individual serving size liquor bottle;

providing the presentation package;

unfolding the presentation package, the presentation package comprising (i) a securing strip, the securing strip including a first loop portion with an exterior surface and an elongated strap portion having an outside surface and an inside surface, the securing strip being comprised of paper card stock, at least the exterior surface and the outside surface having graphics imprinted thereon, the first loop portion comprising a first end of the securing strip adhesively secured to a location generally proximate a middle of the securing strip, (ii) a first adhesive strip including a removable release layer secured to the exterior surface proximate an intersection of the first loop portion and the strap portion and (iii) an informational card secured to the securing strip, the informational card including indicia printed thereon, the informational card being comprised of paper card stock;

writing one or both the name of the gifter and the giftee on the informational card;

sliding the first beverage container into the first loop portion;

placing the second beverage container against the inside surface of the strap portion;

rolling the strap portion around the bottle towards an intersection with the first loop portion;

removing the release layer from the first adhesive strip; and pressing the outside surface against the first adhesive strip to create a second loop portion from the strap portion.

* * * * *